US006713740B2

(12) United States Patent
Hwang

(10) Patent No.: US 6,713,740 B2
(45) Date of Patent: Mar. 30, 2004

(54) MICROWAVE OVEN HAVING HEATERS FOR COOKING FOOD

(75) Inventor: Yun-Ic Hwang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/279,889

(22) Filed: Oct. 25, 2002

(65) Prior Publication Data

US 2004/0031789 A1 Feb. 19, 2004

(30) Foreign Application Priority Data

Aug. 19, 2002 (KR) ..... 2002-49034

(51) Int. Cl.[7] ..... H05B 6/80

(52) U.S. Cl. ..... 219/685; 219/732; 219/763; 126/337 R; 312/236

(58) Field of Search ..... 219/685, 680, 219/732, 762, 763, 392, 395, 396, 397, 398; 126/337 R, 337 A; 312/236; 99/DIG. 14, 451

(56) References Cited

U.S. PATENT DOCUMENTS 4,745,246 A * 5/1988 Hori et al. ..... 219/685
4,870,237 A * 9/1989 Fukumoto ..... 219/754
5,360,965 A * 11/1994 Ishii et al. ..... 219/705
5,793,023 A 8/1998 Hong et al. ..... 219/685
5,968,402 A 10/1999 Lee
6,232,584 B1 5/2001 Meyer
6,381,518 B1 4/2002 Huffington et al.

OTHER PUBLICATIONS

U.S. patent application Ser. No. 10/279,880, Yun–Ic Hwang, filed Oct. 25, 2002.
U.S. patent application Ser. No. 10/279,881, Yun–Ic Hwang, filed Oct. 25, 2002.
U.S. patent application Ser. No. 10/279,879, Yun–Ic Hwang, filed Oct. 25, 2002.

* cited by examiner

*Primary Examiner*—Philip H. Leung
(74) *Attorney, Agent, or Firm*—Staas & Halsey LLP

(57) ABSTRACT

A microwave oven includes a cooking cavity defined by a rear wall, sidewalls, an upper wall and a bottom wall, and a cooking tray installed on the bottom wall of the cooking cavity. An upper heater is installed at a position adjacent to the upper wall of the cooking cavity, and one or more middle heaters are rotatably installed on the rear wall at positions between the upper heater and the cooking tray. Upper supports are provided between the upper heater and the one or more middle heaters so as to horizontally protrude from each of the sidewalls, and lower supports are provided between the one or more middle heaters and the cooking tray so as to horizontally protrude from each of the sidewalls, so that food holding members are removably seated on the upper and lower supports.

23 Claims, 6 Drawing Sheets

FIG. 4A
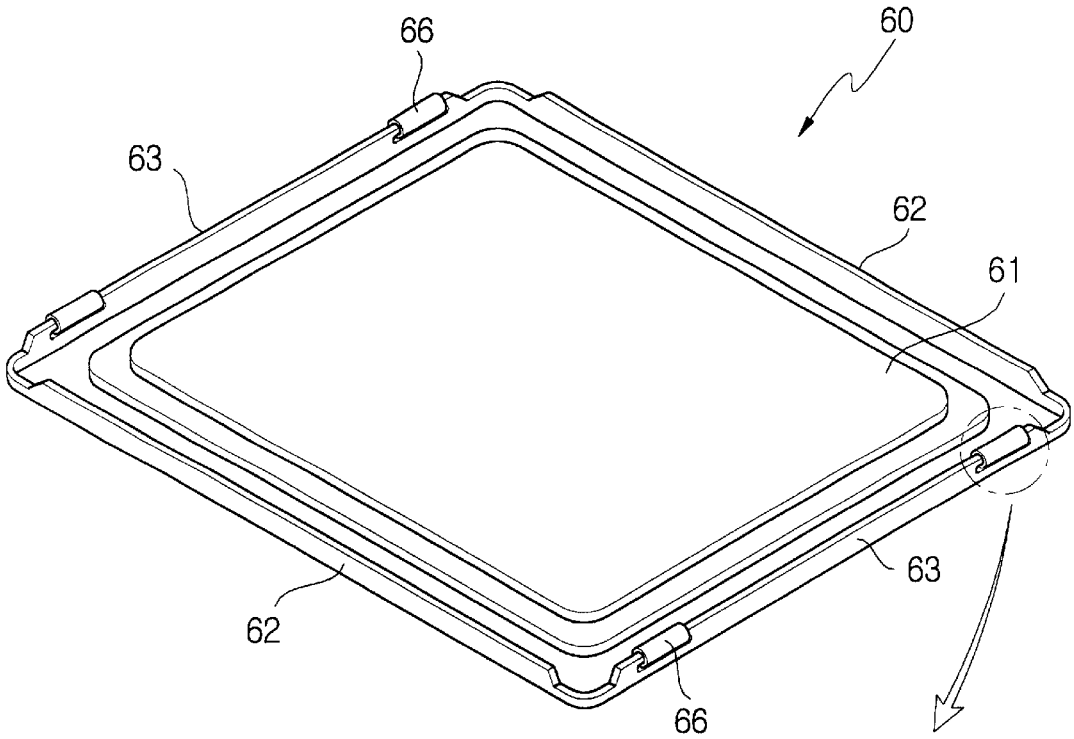
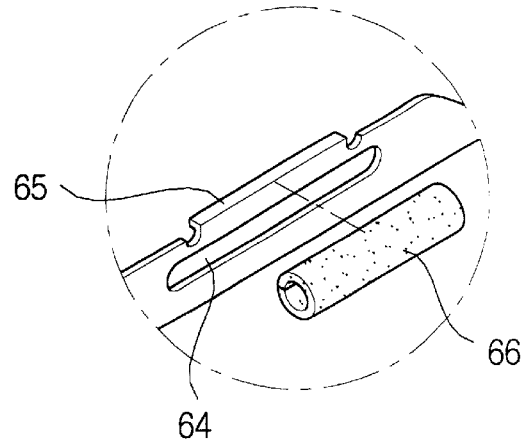
FIG. 4B

MICROWAVE OVEN HAVING HEATERS FOR COOKING FOOD

CROSS REFERENCE TO RELATED APPLICATION

This application claims the benefit of Korean Application No. 2002-49034, filed Aug. 19, 2002, in the Korean Intellectual Property Office, the disclosure of which is incorporated herein by reference.

BACKGROUND OF THE INVENTION

1. Field of the Invention

The present invention relates generally to a microwave oven, and more particularly, to a microwave oven which is designed such that an upper heater and one or more middle heaters are installed at upper and middle portions in a cooking cavity, respectively, and food holding members are slidably provided between the upper and middle heaters and between the middle heaters and a bottom of the cooking cavity, respectively, thus heating the upper and lower parts of the food at the same time, and cooking one or more foods at the same time.

2. Description of the Related Art

A microwave oven is an appliance which cooks and/or heats food laid in a cooking cavity using high-frequency electromagnetic waves generated by an oscillation of a magnetron installed in a machine room. That is, the high-frequency electromagnetic waves penetrate food laid in the cooking cavity so as to repeatedly change a molecular arrangement of moisture in the food. The food is cooked by frictional heat generated by molecules.

However, when food is cooked using only the high-frequency electromagnetic waves, the high-frequency electromagnetic waves do not uniformly penetrate the food. Instead penetration of the food is according to content or distribution of the moisture of the food and a size of the food. Thus, the food is not satisfactorily cooked when using only the high-frequency electromagnetic waves and to cook the food in a variety of manners may not be possible. In order to solve such problems, a microwave oven is provided with a heater at an upper portion in a cooking cavity thereof, thus cooking the food by high-frequency electromagnetic waves, and rapidly and uniformly cooking the food by heat generated from the heater, as well as browning a surface of the food by heat of a high temperature generated from the heater.

FIG. 1 schematically shows a conventional microwave oven having a heater at an upper portion of a cooking cavity. As shown in FIG. 1, the conventional microwave oven comprises a cooking cavity 1 and a machine room 2. The cooking cavity 1 defines a space for cooking food. Several electrical devices, including a magnetron 3 to generate high-frequency electromagnetic waves, are installed in the machine room 2.

A heater 4 heating the food to be cooked is installed at the upper portion of the cooking cavity 1. A turntable-type cooking tray 5 is installed at a lower portion of the cooking cavity 1. A motor 6 to rotate the turntable-type cooking tray 5 is installed under a bottom of the cooking cavity 1. The food to be cooked is laid on the turntable-type cooking tray 5, and the motor 6 rotates the turntable-type cooking tray 5.

The method of cooking the food using a conventional microwave oven constructed, as above described, is as follows. As the magnetron 3 and the motor 6 are operated, the cooking tray 5 on which the food is laid is rotated at a low speed. At this time, high-frequency electromagnetic waves penetrate the food to cook the food. Further, when the heater 4 installed at the upper portion in the cooking cavity 1 is operated, the food is cooked by heat generated from the heater 4. As such, when the heater 4 and the magnetron 3 are operated at the same time, the food is rapidly cooked by the heat of the heater 4 and the high-frequency electromagnetic waves.

However, since the conventional microwave oven is provided at the upper portion in the cooking cavity with only one heater, the distance between the heater and the food is large in the case of cooking small-sized food, so heat generated from the heater is not effectively transmitted to the food. Moreover, since heat is not sufficiently transmitted to a lower part of the food, the food must be turned upside down during a cooking process so as to desirably cook and brown the lower part of the food, thereby making cooking the food inconvenient using the conventional microwave oven.

Further, since the conventional microwave oven is designed such that the cooking cavity forms a single cooking space to cook the food, which is laid on the cooking tray, cooking several foods at one time, is not possible so cooking the food takes a long time.

SUMMARY OF THE INVENTION

Accordingly, it is an aspect of the present invention to provide a microwave oven, which is designed to heat upper and lower parts of food at a same time so that turning the food upside down during a cooking process is not needed.

Another aspect is to provide a microwave oven, which is designed to removably mount one or more food holding members in a cooking cavity, thus cooking several foods at a same time.

Additional aspects and advantages of the invention will be set forth in part in the description which follows and, in part, will be obvious from the description, or may be learned by practice of the invention.

In order to accomplish the above and other aspects, a microwave oven, comprising a cooking cavity defined by a rear wall, sidewalls, an upper wall and a bottom wall, and a cooking tray installed on the bottom wall of the cooking cavity, wherein an upper heater is installed at a position adjacent to the upper wall of the cooking cavity, and one or more middle heaters are rotatably installed on the rear wall at positions between the upper heater and the cooking tray, upper supports are provided between the upper heater and the middle heaters so as to horizontally protrude from each of the sidewalls, and lower supports are provided between the middle heaters and the cooking tray so as to horizontally protrude from each of the sidewalls, whereby a food holding unit is removably mounted on the upper and lower supports.

In the microwave oven, a projection is provided on a sidewall of the cooking cavity at a position above the upper supports so as to protrude by a predetermined length toward a center of the cooking cavity, thus preventing the food holding unit from tilting downwards and falling to the floor when the food holding unit slides out of the cooking cavity.

In the cooking cavity, a vertical step is provided at a position between the upper and lower supports so as to be positioned at a front portion of a sidewall of the cooking cavity, thus preventing the food holding unit from colliding with the middle heaters when putting the food holding unit between the upper and lower supports.

The food holding unit comprises a first food holding member fabricated in a form of a wire rack and a second food holding member fabricated in a form of a tray.

A tube made of a nonconductive and heat-resistant material is fitted over each side end of the first food holding member so that the tube comes into contact with the upper supports or the lower supports when the first food holding member is mounted in the cooking cavity, thus preventing sparks from arcing between the first food holding member and the upper supports or the lower supports, and allowing the first food holding member to smoothly slide in and out of the cooking cavity.

A stopper having a predetermined length extends from a central portion of each of front and rear ends of the first food holding member, thus allowing the first food holding member to be spaced apart from the rear wall of the cooking cavity by a predetermined length.

A flange downwardly extends along an edge of the second food holding member to have a predetermined width so that the flange lays on the upper supports or the lower supports when the second food holding member slides in and out of the cooking cavity.

At least one tube made of a nonconductive and heat-resistant material is fitted over a lower end of the flange so that the tube comes into contact with the upper supports or the lower supports when the second food holding member is mounted in the cooking cavity, thus preventing sparks from arcing between the second food holding member and the upper supports or the lower supports, and allowing the second food holding member to smoothly slide in and out of the cooking cavity.

BRIEF DESCRIPTION OF THE DRAWINGS

These and other aspects and advantages of the invention will become apparent and more readily appreciated from the following description of the preferred embodiments, taken in conjunction with the accompanying drawings of which:

FIG. 4A is a bottom perspective view of the second food holding member according to the embodiment of the present invention, the second food holding member being fabricated in a form of a tray;

FIG. 4B is an exploded view of the area A in FIG. 4A;

DETAILED DESCRIPTION OF THE PREFERRED EMBODIMENT

Figure 1:
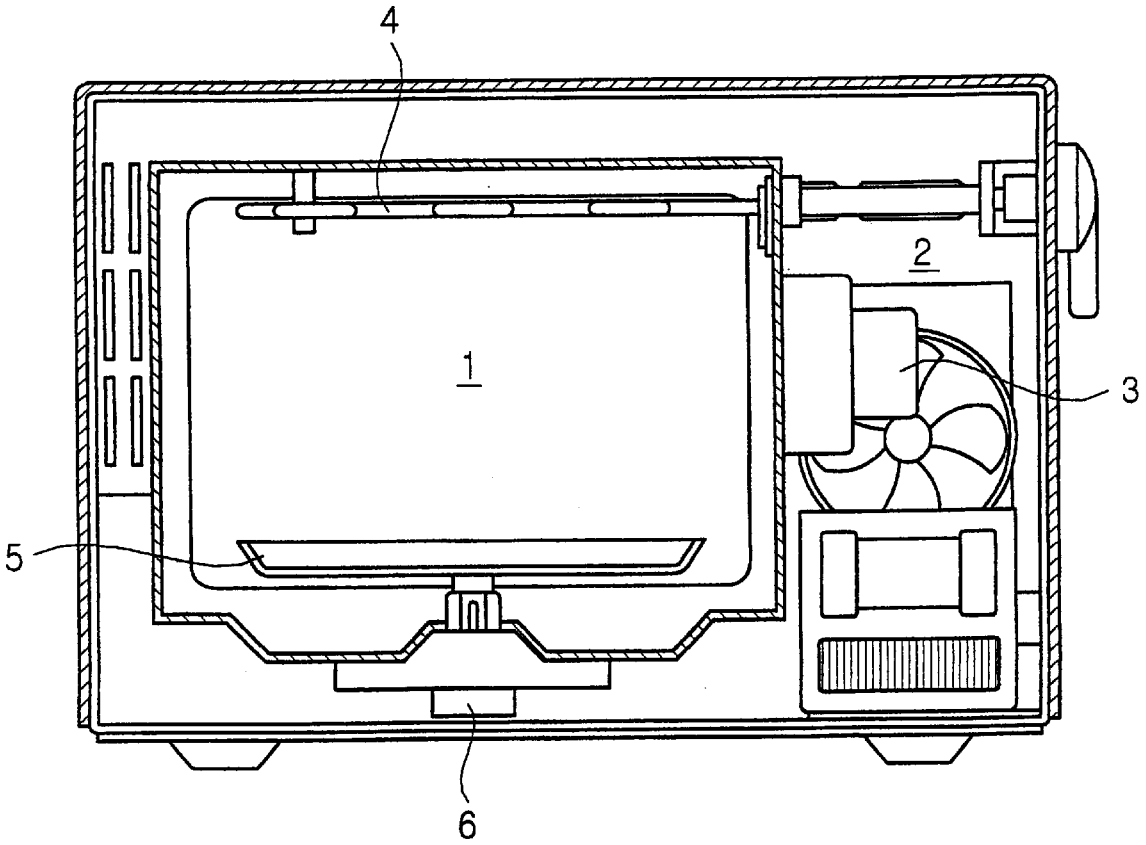
FIG. 1 PRIOR ART
FIG. 1 is a front sectional view showing a conventional microwave oven having a heater at an upper portion in a cooking cavity.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
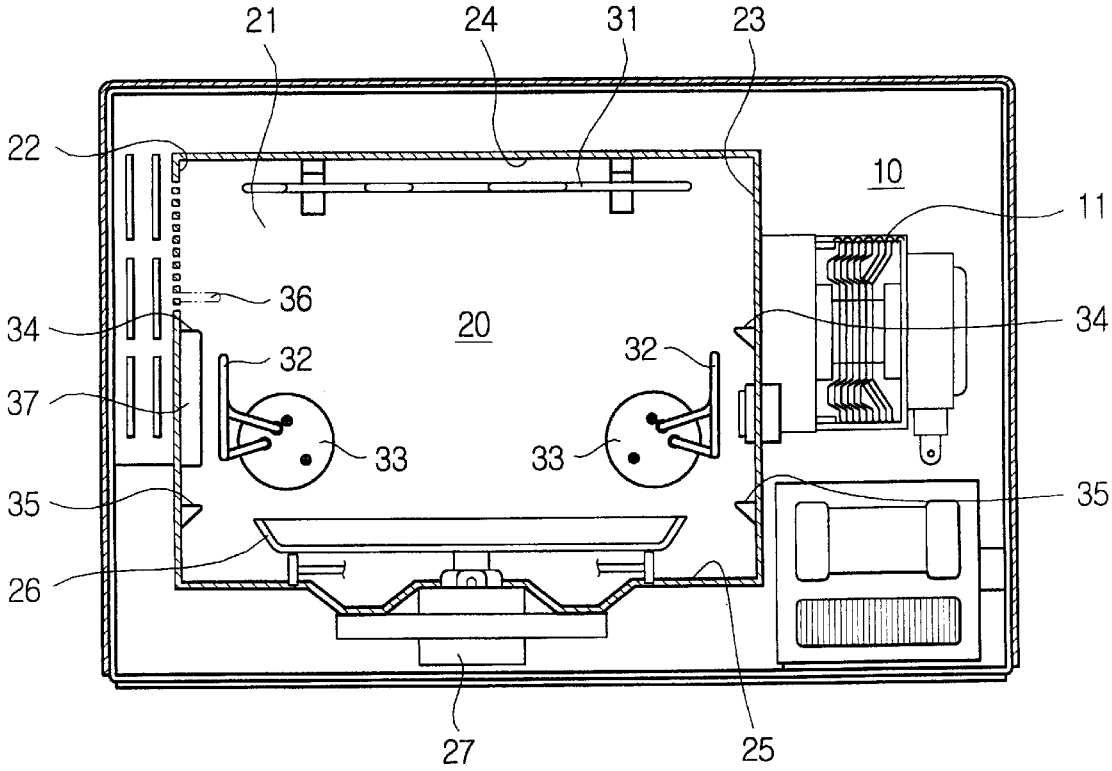
FIG. 2 is a front sectional view showing a microwave oven according to an embodiment of the present invention, the microwave oven provided such that an upper heater and one or more middle heaters are installed at an upper portion and a middle portion in a cooking cavity, respectively, and upper and lower supports are provided between the upper heater and the one or more middle heaters and between the one or more middle heaters and a bottom wall of the cooking cavity, respectively, to support a first food holding member and a second food holding member, respectively.

FIG. 2 is a front sectional view showing a microwave oven according to an embodiment of the present invention, the microwave oven being provided such that an upper heater and one or more middle heaters are installed at an upper portion and a middle portion in a cooking cavity, respectively, and upper supports and lower supports are provided between the upper heater and the one or more middle heaters and between the one or more middle heaters and a bottom wall of the cooking cavity, respectively, to support a first food holding member and a second food holding member, respectively.

As shown in FIG. 2, the microwave oven comprises a machine room 10 and a cooking cavity 20. Several electrical devices, including a magnetron 11, are installed in the machine room 10 so as to generate high-frequency electromagnetic waves. The housing of the microwave oven is partitioned into the machine room 10 and the cooking cavity 20 which defines a space to cook the food. High-frequency electromagnetic waves generated by the magnetron 11 are transmitted to the cooking cavity 20 to cook the food, which is placed in the cooking cavity 20.

The cooking cavity 20 is defined by a rear wall 21, left sidewall 22 and right sidewall 23, an upper wall 24 and a bottom wall 25, and is open at a front of the cooking cavity 20. A door (not shown) is mounted to the open front so as to selectively open the cooking cavity 20. A turntable-type cooking tray 26 and a motor 27 are installed at positions above and under the bottom wall 25 of the cooking cavity 20, respectively. The food to be cooked is placed on the turntable-type cooking tray 26.

An upper heater 31 is installed at a position adjacent to the upper wall 24 of the cooking cavity 20 and emits heat of a high temperature downwardly in the cooking cavity 20. One or more middle heaters 32 are installed between the upper heater 31 and the turntable-type cooking tray 26 and emit heat of a high temperature upwardly and downwardly in the cooking cavity 20. That is, the upper heater 31 is positioned at an upper portion in the cooking cavity 20, and the one or more middle heaters 32 are positioned between the upper heater 31 and the turntable-type cooking tray 26. Thus, heat is transmitted to upper and lower parts of the food placed between the upper heater 31 and the one or more middle heaters 32. Further, heat is transmitted to the upper part of the food placed between the one or more middle heaters 32 and the turntable-type cooking tray 26.

Figure 5:
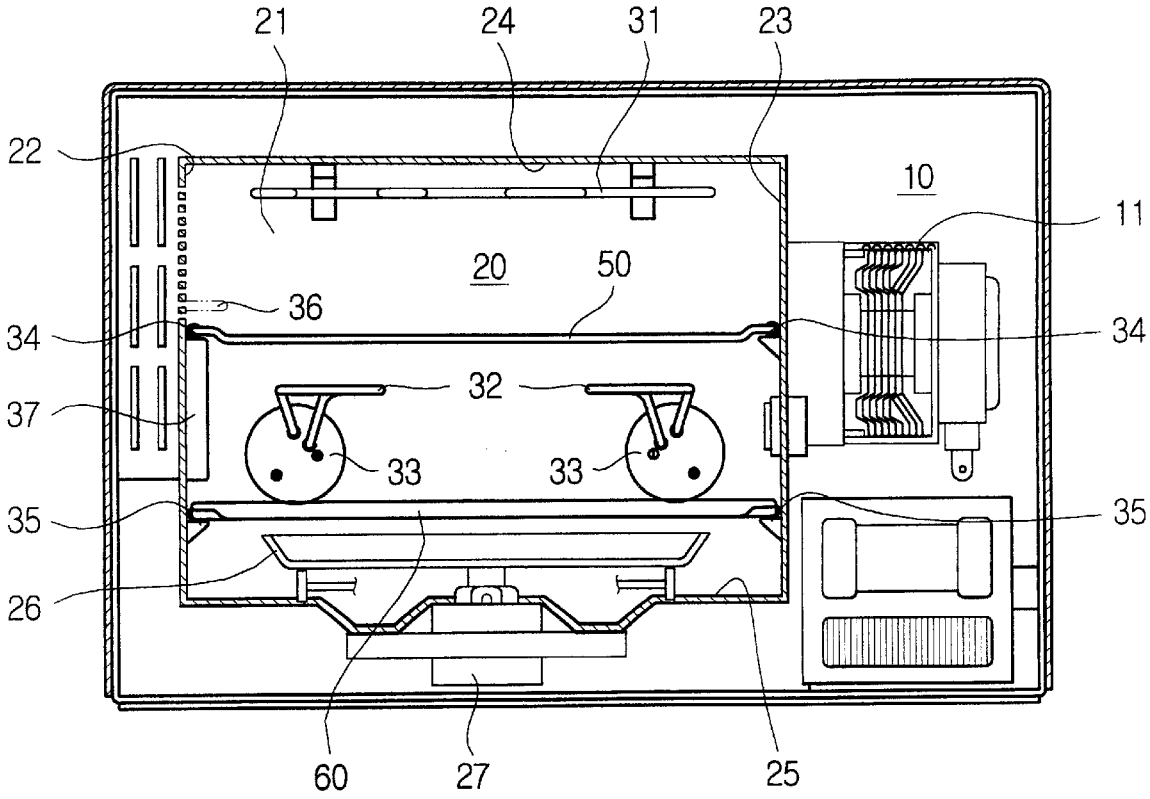
FIG. 5 is a view corresponding to FIG. 2, but showing the microwave oven the embodiment of the present invention, with the first food holding member and the second food holding member being seated on upper supports and lower supports, respectively.

Each of the one or more middle heaters 32 is fixed to one rotating member of a pair of rotating members 33 which are rotatably installed on the rear wall 21 of the cooking cavity 20. As the rotating members 33 are rotated by a drive unit (not shown) which is installed outside the cooking cavity 20, the one or more middle heaters 32 may be rotated between vertical closed positions, respectively, for which the one or more heaters 32 face the side walls 22 and 23, as shown in FIG. 2, and horizontal open positions, respectively, for which the one or more heaters 32 are directed to a center of the cooking cavity 20 as shown in FIG. 5.

A pair of upper supports 34 is provided between the upper heater 31 and the one or more middle heaters 32 so as to horizontally and inwardly protrude from the left and right sidewalls 22 and 23, respectively. The pair of upper supports 34 supports a first food holding member 50 or a second food holding member 60 described hereinafter (see FIGS. 3, 4A and 4B) so as to slide in and out of the cooking cavity 20. In the similar manner as the upper supports 34, a pair of lower supports 35 are provided between the one or more middle heaters 32 and the turntable-type cooking tray 26 so as to horizontally and inwardly protrude from the left and right sidewalls 22 and 23, respectively. The pair of lower supports 35 support the first food holding member 50 or the second food holding member 60 so as to allow the first food holding member 50 or the second food holding member 60 to slide in and out of the cooking cavity 20.

The first and second food holding members 50 and 60 are removably seated on the upper and lower supports 34 and 35, thus allowing one or more food items to be cooked in the cooking cavity 20.

A projection 36 is provided on a front portion of the left sidewall of the cooking cavity 20 at a position above one of the upper supports 34 and is spaced apart from the one upper support 34 by a predetermined interval. The projection 36 horizontally protrudes by a predetermined length toward the center of the cooking cavity 20. When the first food holding member 50 or the second food holding member 60, which is seated on the upper supports 34, slides out of the cooking cavity 20, the projection 36 prevents the first food holding member 50 or the second food holding member 60 from tilting excessively downward and falling to the floor due to the weight of the food (see FIG. 6). The projection 36 may be installed on the right sidewall 23 in place of the left sidewall 22 or two projections 36 may be installed on the left and right sidewalls 22 and 23, respectively.

A vertical step 37 is provided at a position between the upper and lower supports 34 and 35 so as to be positioned at the front portion of the left sidewall 22, and prevents the first food holding member 50 or second food holding member 60 from interfering with the one or more middle heaters 32 which are positioned between the upper and lower supports 34 and 35. As shown in FIG. 2, the vertical step 37 is designed to be slightly longer than each middle heater 32, in a vertical length, when each middle heater 32 is placed at closed positions at which the one or more middle heaters 32 face the left sidewall 22 or the right sidewall 23, so that the first holding member 50 or second food holding member 60 is prevented from being undesirably in contact with the one or more middle heaters 32, thus preventing damage to the first and second food holding members 50 and 60.

Figure 3:
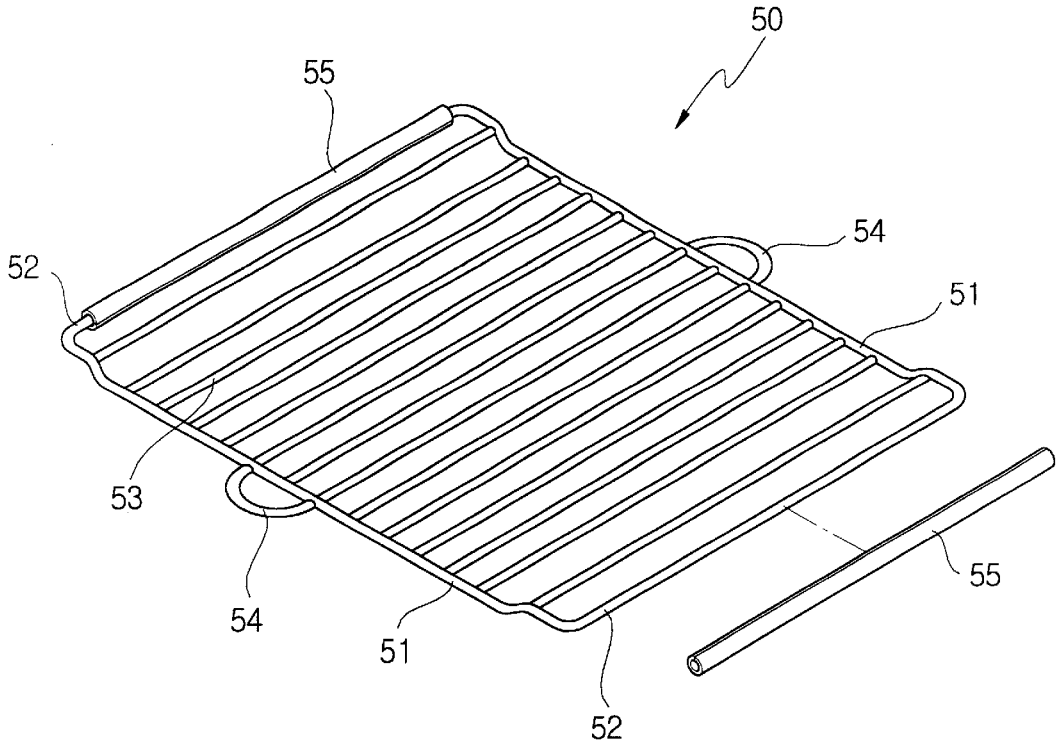
FIG. 3 is a perspective view of the first food holding member according to the embodiment of the present invention, the first food holding member being fabricated in a form of a wire rack.

FIG. 3 is a perspective view of the first food holding member 50 according to the present invention. As shown in the FIG. 3, the first food holding member 50 is fabricated in a form of a wire rack, which has spaces, opened to a top and a bottom. The first food holding member 50 comprises front and rear bars 51, two side bars 52, and a plurality of support bars 53 formed into a single structure with a rectangular shape. In this case, the support bars 53 are arranged at regular intervals in a space defined by the front and rear bars 51 and the two side bars 52 which form edges of the first food holding member 50. The first food holding member 50 having such a construction may be used to cook some kinds of food, such as fish or meat, which are placed on the support bars 53, by heat of the upper heater 31 and the one or more middle heaters 32 or the high-frequency electromagnetic waves.

A stopper 54 having a semi-circular cross-section is provided at a central portion of each of front and rear bars 51 so as to horizontally extend from the front and rear bars 51 by a predetermined length. The stopper 54 makes one of the front or rear bars 51 be spaced apart from the rear wall 21 of the cooking cavity 20 by a predetermined length when the first food holding member 50 is installed in the cooking cavity 20, to prevent sparks from arcing between one of the front or rear bars 51 and the rear wall 21 and to effectively transmit heat from the upper heater 31 and the one or more middle heaters 32 to the food placed on the first food holding member 50.

A tube 55 made of a nonconductive and heat-resistant material is fitted over each of the side bars 52 of the first food holding member 50. The tubes 55 allow the first food holding member 50 to come into contact with the upper supports 34 or the lower supports 35 when the first food holding member 50 is seated on the upper supports 34 or lower supports 35, respectively, thus preventing sparks from arcing between the first food holding member 50 and the upper supports 34 or lower supports 35, and allowing the first food holding member 50 to smoothly slide in and out of the cooking cavity 20 without wearing out the upper supports 34 or lower supports 35.

The tubes 55 are made of a nonconductive and heat-resistant material and may be made of Teflon.

Since each of the stoppers 54 provided at the front and rear bars 51 is in spot-contact with the rear wall 21, there are few sparks and little abrasion between the rear wall 21 of the cooking cavity 20 and the stopper 54. But, when the tubes 55 are fitted over the stoppers 54, sparks and abrasion are more effectively prevented.

The first food holding member 50 is constructed with open spaces between the bars 51, 52 and 53, thus uniformly cooking and browning the upper and lower surfaces of the food and effectively removing grease when cooking some kinds of food, such as fish or meat.

FIG. 4A is a bottom perspective view showing a second food holding member 60 according to the embodiment of the present invention. As shown in the FIG. 4A, a food reception part 61 is concavely and downwardly provided on the second food holding member 60 to create a rectangular tray structure, and receives food to be cooked. The second food holding member 60 has front and rear flanges 62 and two side flanges 63, which downwardly extend from an edge of the second food holding member 60. That is, the side flanges 63 of the second food holding member 60 are primarily seated on the upper supports 34 or lower supports 35 provided in the cooking cavity 20 and then slide in and out of the cooking cavity 20 so that the second food holding member 60 is installed in and removed from the cooking cavity 20.

As shown in FIG. 4B, in the same manner as the first food holding member 50, tubes 66, which are made of a nonconductive and heat-resistant material, are fitted over front and rear portions of the side flanges 63 at predetermined positions so as to prevent sparks from being produced when cooking food placed on the second food holding member 60 seated on the upper supports 34 or the lower supports 35. Each of the tubes 66 is held on a side flange 63 of the second food holding member 60 as the sidewall of each of the tubes 66 is inserted into a respective longitudinal hole 64 which is formed at a predetermined position of the front and rear portions of the side flange 63 of the second food holding member 60. A lug 65 horizontally and inwardly projects from an edge of each of the side flanges 63 at a position around each longitudinal hole 64 so that the sidewall of each of the tubes 66 is inserted into the respective longitudinal hole 64 as an inner surface of each of the tubes 66 is locked to the lug 65, thus locking the tubes 66 to each of the respective longitudinal holes 64 without allowing an unexpected movement of each of the respective tubes 66. Each of the tubes 66 may be made of Teflon which is heat-resistant and non-conductive in the same manner as the tubes 55 of the first food holding member 50.

Although the tubes 66 are fitted over only the side flanges 63 of the second food holding member 60, the tubes 66 may be fitted over the front and rear flanges 62, as well as the side flanges 63, so as to effectively prevent sparks from arcing between the second food holding member 60 and the rear wall 21 of the cooking cavity 20.

The second food holding member 60 may be made of a metal, and further may be made of aluminum which is light and has excellent heat-conductivity.

FIG. 5 is a view showing the microwave oven of the embodiment of the present invention, when the first and second food holding members 50 and 60 are seated on the upper and lower supports 34 and 35, respectively. As shown in the FIG. 5, the first and second food holding members 50 and 60 are mounted in or removed from the cooking cavity 20 by sliding the first and second food holding members 50 and 60 in or out of the cooking cavity 20, as the tubes 55 and 66 directly come into contact with the upper and lower supports 34 and 35.

As shown in FIG. 5, when the first food holding member 50 is seated on the upper supports 34 and the second food holding member 60 is seated on the lower supports 35, the upper heater 31 and the two middle heaters 32 are operated to uniformly cook upper and lower parts of greasy food, such as meat, while browning a surface of the food. At this time, grease from the food, such as meat, which is placed on the first food holding member 50, falls to the second food holding member 60 which is fabricated in a form of a tray.

Further, the second food holding member 60, which may be made of aluminum, reflects radiant heat transmitted from the upper heater 31 and one or more middle heaters 32, to the first food holding member 50, so the heat generated from the heaters 31 and 32 is more effectively used.

As shown in FIG. 5, when both the first and second food holding members 50 and 60 are mounted in the cooking cavity 20, many pieces of bread can be browned at one time, thus rapidly making many pieces of toast.

Further, when cooking food, such as cookies, pizza, or cake, a user may put the second food holding member 60 fabricated in the form of a tray on one of the upper and lower supports 34 and 35 and operate the upper heater 31 and one or more middle heaters 32.

When high-frequency electromagnetic waves generated by the magnetron 11 are transmitted to the cooking cavity 20, in addition to an operation of the heaters 31 and 32, food placed on the first and second food holding members 50 and 60 is more rapidly cooked.

Figure 6:
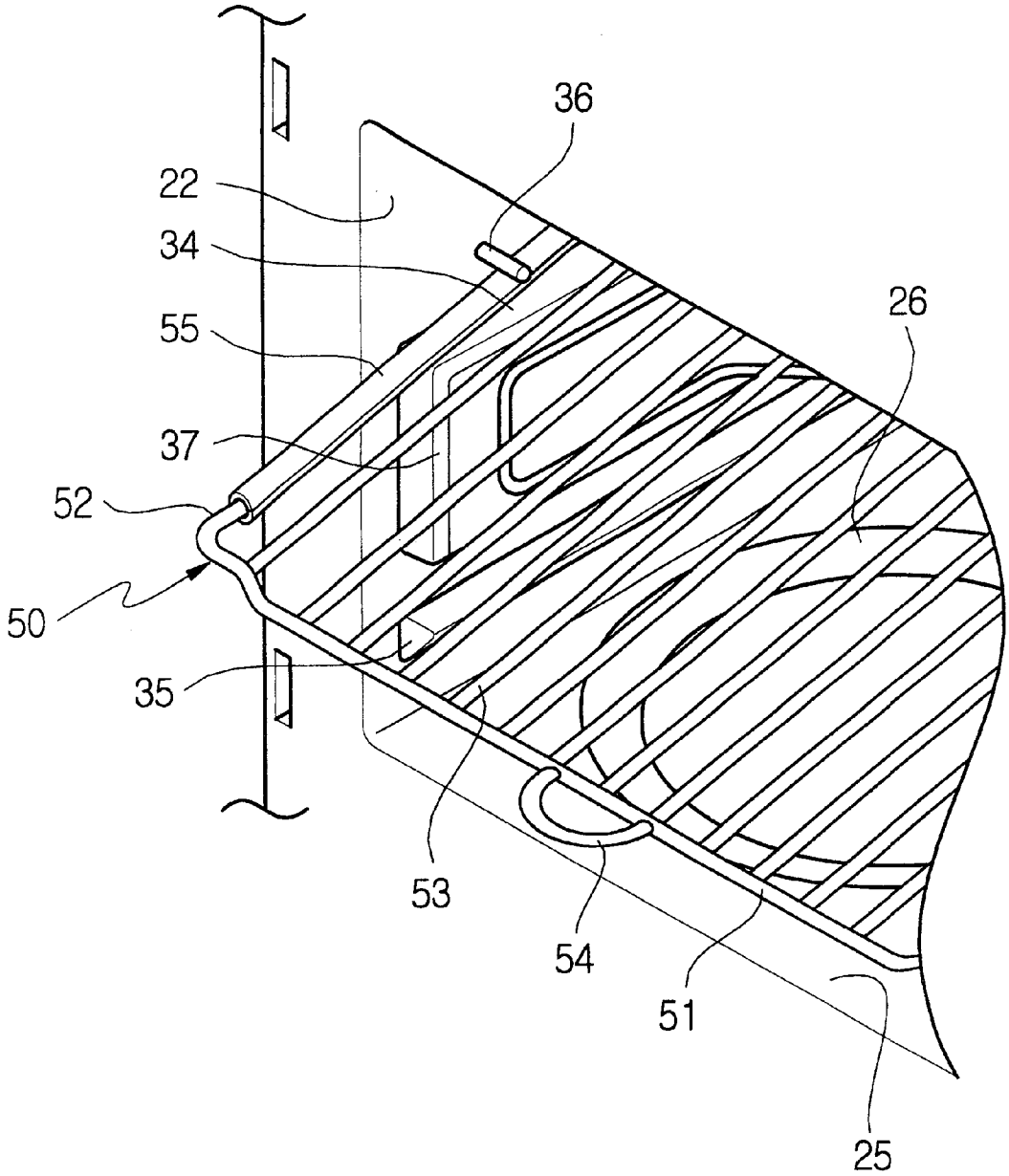
FIG. 6 is a partial perspective view showing the microwave oven of the embodiment of the present invention, with the first food holding member being stopped by a projection, which is provided above the upper support, when the food holding member tilts downward.

FIG. 6 is a partial perspective view showing the microwave oven of the embodiment of the present invention, with the first food holding member 50 being stopped by the projection 36 which is provided above one of the upper supports 34. As shown in the FIG. 6, the projection 36 is provided at a front portion of the left sidewall 22 of the cooking cavity 20 so as to project toward a center of the cooking cavity 20 by a predetermined length, and is positioned above the one upper support 34 of the left sidewall 22 and the projection 36 is spaced apart from the one upper support 34 by a predetermined length. When the first food holding member 50 slides out of the cooking cavity 20 to be removed from the cooking cavity 20, the front portion of the first food holding member 50 may be tilted downward by a weight of the food or carelessness of the user. At this time, one of the side bars 52 is stopped by the projection 36 so as to prevent the first food holding member 50 from falling to the floor, thus preventing food placed on the first food holding member 50 from spilling.

As described above, a microwave oven is provided, which is designed such that an upper heater is provided at a position adjacent to the upper wall of a cooking cavity and one or more middle heaters is provided between a turntable-type cooking tray and the upper heater so that upper and lower surfaces of the food, which is placed on a food holding member, face the upper heater and the one or more middle heaters, respectively, so that heat generated from the heaters is effectively transmitted to the food, therefore rapidly and uniformly cooking the food.

The microwave oven is provided having sidewalls of the cooking cavity with upper and lower supports so that one or more food holding members are mounted in the cooking cavity, thus cooking a large quantity of food at one time, therefore reducing overall cooking time.

Further, the microwave oven is designed to prevent sparks from arcing between the food holding members and the rear wall of the cooking cavity and to prevent sidewalls of the cooking cavity from being worn, thus safely cooking the food and lengthening a life span of the microwave oven.

Further, the microwave oven is provided with a projection on a sidewall so as to prevent a food holding member from undesirably falling down from the microwave oven when pulling the food holding member from the cooking cavity, thus safely allowing the food to be taken out of the cooking cavity.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A microwave oven, comprising:

a cooking cavity having a rear wall, sidewalls, an upper wall and a bottom wall; and a cooking tray installed on the bottom wall of the cooking cavity;

an upper heater installed at a position adjacent to the upper wall of the cooking cavity;

one or more middle heaters rotatably installed on the rear wall at positions between the upper heater and the cooking tray;

an upper support provided between the upper heater and the one or more middle heaters so as to horizontally protrude from each of the sidewalls; and a lower support provided between the one or more middle heaters and the cooking tray so as to horizontally protrude from each of the sidewalls, wherein one or more food holding units are removably installed on the upper support or the and lower support.

2. The microwave oven according to claim 1, further comprising a projection provided on one of the sidewalls of the cooking cavity at a position above the upper support so as to protrude a predetermined length toward a center of the cooking cavity, preventing one of the food holding units from tilting downwardly to separate from the microwave oven when the one food holding unit slides out of the cooking cavity.

3. The microwave oven according to claim 2, comprising a vertical step at a position between the upper support and lower support so as to be positioned at a front portion of one of the sidewalls of the cooking cavity, preventing the food holding units from coming into contact with the one or more middle heaters when putting the food holding units between the upper support and lower support.

4. The microwave oven according to claim 1, wherein each of the food holding units comprises one of a first food holding member and a second food holding member, said first food holding member being fabricated in a form of a wire rack and said second food holding member being fabricated in a form of a tray.

5. The microwave oven according to claim 4, further comprising a tube made of a nonconductive and heat-resistant material fitted over each side end of the first food holding member so that the tube comes into contact with one of the upper support and the lower support when the first food holding member is installed in the cooking cavity, preventing sparks from arcing between the first food holding member and one of the upper support and the lower support, and allowing the first food holding member to smoothly slide in and out of the cooking cavity.

6. The microwave oven according to claim 5, wherein the tube made of polytetrafluoroethylene.

7. The microwave oven according to claim 4, further comprising a stopper having a predetermined length extending from a central portion of each of a front end and a rear end of the first food holding member, allowing the first food holding member to be spaced apart from the rear wall of the cooking cavity by a predetermined length.

8. The microwave oven according to claim 4, wherein the second food holding member is made of aluminum, effectively transmitting heat generated by the upper heater and the one or more middle heaters to the food.

9. The microwave oven according to claim 4, further comprising a flange downwardly extending along an edge of the second food holding member to have a predetermined width so that the flange is placed on one of the upper support and the lower support when the second food holding member slides in and out of the cooking cavity.

10. The microwave oven according to claim 9, further comprising at least one tube made of a nonconductive and heat-resistant material fitted over a lower end of said flange so that the at least one tube contacts with one of the upper support and the lower support when the second food holding member is installed in the cooking cavity, preventing sparks from arcing between the second food holding member and one of the upper support and the lower support and allowing the second food holding member to smoothly slide in and out of the cooking cavity.

11. The microwave oven according to claim 10, wherein the flange is provided with a longitudinal hole and a lug horizontally projecting from an edge of the flange at a position around the longitudinal hole, so that the at least one tube is inserted into the longitudinal hole with an inner surface of the at least one tube being locked to the lug.

12. The microwave oven according to claim 10, wherein the at least one tube is made of polytetrafluoroethylene.

13. A microwave oven including first and second removable food holding units for holding food to be cooked by the microwave oven, comprising:

a cooking cavity;

a plurality of heaters disposed inside the cooking cavity;

the first and second removable food holding units each disposed between at least two heaters of the plurality of heaters and allowing top and bottom surfaces of the food to be cooked, respectively, at top and bottom surfaces of the food; and one or more vertical steps provided at one or more positions between the first and second removable food holding units so as to be positioned at a front portion of one or more sidewalls of the cooking cavity, preventing the first and second food holding units from contacting the plurality of heaters when inserting each of the first and second removable food holding units into the cooking cavity.

14. The microwave oven according to claim 13, further comprising:

an upper support attached to the sidewalls and supporting one of the first and second food holding units; and a projection provided on one of the sidewalls of the cooking cavity at a position above the upper support so as to protrude a predetermined length toward a center of the cooking cavity, preventing one of the first and second food holding units from tilting downwardly and separating from the microwave oven when the one food holding unit slides out of the cooking cavity.

15. The microwave oven according to claim 14, further comprising:

a lower support attached to the sidewalls below the upper support and supporting another one of the first and second food holding units, wherein the first food holding unit comprises, front and rear ends, side ends attached to the front and rear ends of the first food holding unit, and tubes formed from a nonconductive and heat-resistant material, which are fitted over each of the side ends of the first food holding unit so that the tubes contact with the upper support or lower support when the first food holding unit is disposed in the cooking cavity, preventing sparks from arcing between the first food holding unit and the upper support or lower support, and allowing the first food holding unit to smoothly slide in and out of the cooking cavity.

16. The microwave oven according to claim 15, wherein the tubes are made of polytetrafluoroethylene.

17. The microwave oven according to claim 15, further comprising:

a stopper having a predetermined length extending from each of the front and rear ends of the first food holding unit, ensuring a space of a predetermined length between the front and rear ends of the first food holding unit and a rear wall of the cooking cavity.

18. The microwave oven according to claim 17, further comprising a nonconductive and heat resistant tube fitted over the stopper and the stopper is in spot contact with the cooking cavity, preventing sparks within the cooking cavity.

19. The microwave oven according to claim 15, wherein the second food holding unit comprises:

a flange extending downwardly along an edge of the second food holding member to have a predetermined width so that the flange is placed on one of the upper support and the lower support when the second food holding member slides in and out of the cooking cavity.

20. The microwave oven according to claim 19, wherein each of the tubes is fitted over a lower end of the flange so that each of the tubes is contactable with one of the upper support and the lower support when the second food holding unit is placed in the cooking cavity, preventing sparks from arcing between the second food holding unit and one of the upper support and lower support, and allowing the second food holding unit to slide in and out of the cooking cavity.

21. The microwave oven according to claim 20, wherein said flange comprises:

a elongated hole; and a lug projecting from an edge of the flange at a position around the elongated hole so that one of the tubes is insertable into the elongated hole, with an inner surface of the one tube locking to the lug.

22. The microwave oven according to claim 21, wherein the one tube is made of polytetrafluoroethylene.

23. The microwave oven according to claim 13, wherein the first food holding unit is in a form of a wire rack and the second food holding member is in a form of a tray.

* * * * *